US007033044B2

(12) United States Patent
Griffin

(10) Patent No.: US 7,033,044 B2
(45) **Date of Patent: *Apr. 25, 2006**

(54) HORIZONTALLY AND VERTICALLY ADJUSTABLE LIGHTING SYSTEM AND METHOD

(75) Inventor: Mary Griffin, Los Angeles, CA (US)

(73) Assignee: Farsight LLC, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/688,463

(22) Filed: Oct. 16, 2003

(65) Prior Publication Data

US 2005/0083690 A1 Apr. 21, 2005

(51) Int. Cl.
*F21V 21/14* (2006.01)
*F21V 21/32* (2006.01)

(52) U.S. Cl. ..... 362/250; 362/232; 362/233; 362/270; 362/271

(58) Field of Classification Search ..... 362/85, 362/219–220, 232–233, 249–250, 269–272, 362/277, 282–284
See application file for complete search history.

(56) References Cited

U.S. PATENT DOCUMENTS 2,659,038 A * 11/1953 Heyer ..... 315/316
3,840,842 A 10/1974 Gabryelewicz
4,392,187 A * 7/1983 Bornhorst ..... 362/233
4,712,167 A 12/1987 Gordin et al.
4,731,711 A 3/1988 Engel
4,837,665 A * 6/1989 Hoyer et al. ..... 362/96
4,862,336 A 8/1989 Richardson et al.
4,924,366 A 5/1990 Shemitz et al.
4,980,806 A * 12/1990 Taylor et al. ..... 362/85
4,994,944 A 2/1991 Vernondier
5,008,967 A * 4/1991 Barrios et al. ..... 14/7
5,237,792 A * 8/1993 Oberman et al. ..... 52/645
5,278,742 A * 1/1994 Garrett ..... 362/233
5,329,431 A 7/1994 Taylor et al.
5,335,468 A 8/1994 Oberman et al.
5,406,176 A * 4/1995 Sugden ..... 315/292
5,432,691 A 7/1995 Garrett et al.
5,519,590 A 5/1996 Crookham et al.
5,551,199 A * 9/1996 Hayes et al. ..... 52/648.1
5,564,818 A 10/1996 Grossman et al.
5,668,537 A 9/1997 Chansky et al.
5,893,636 A 4/1999 Babineaux
5,993,030 A * 11/1999 Barcel ..... 362/408
6,331,756 B1 12/2001 Belliveau
6,676,275 B1 * 1/2004 Westhofen ..... 362/249
2002/0149927 A1 10/2002 Westhofen

* cited by examiner

*Primary Examiner*—Stephen Husar
*Assistant Examiner*—Jason Han
(74) *Attorney, Agent, or Firm*—Pillsbury Winthrop Shaw Pittman LLP

(57) ABSTRACT

A moveable, adjustable lighting system for use in television/movie sets and locations, and other similar indoor/outdoor applications comprises at least one horizontal framework that is disposed on a plurality of vertical members in such a way as to allow the horizontal and vertical dimensions of the system, as well as the individual lights and fixtures within the system to be adjusted and adapted to the requirements of a specific set. Lights, lighting fixtures, and other similar fixtures are connected in such a way as to enable them and/or the dimensions of the system to be remotely controlled. The vertical members are equipped with moving means, such as rollers, that allow the entire rig to be moved from one set to another. The system suggests and embodies an "assembly-line production" process in which sets are separately constructed to allow the rig to move between and among them.

48 Claims, 9 Drawing Sheets

Prior Art

HORIZONTALLY AND VERTICALLY ADJUSTABLE LIGHTING SYSTEM AND METHOD

RELATED APPLICATION

The instant application is directed to subject matter that is similar to that disclosed in patent application Ser. No. 09/835,322, filed Apr. 13, 2001, and published on Oct. 17, 2002 under Publication No. US-2002-0149927-A 1.

BACKGROUND OF THE INVENTION

1. Field of the Invention

This invention is in the field of lighting systems and, more particularly, directed to a moveable, adjustable lighting system used in conjunction with television and movie sets and locations, as well as other similar indoor and outdoor applications, wherein the horizontal and vertical dimensions of the system, as well as the individual lights and fixtures within the system can be adapted to the requirements of a specific set, and the system as a whole can be moved so as to be used in multiple sets.

2. Art Background

Traditionally, a dramatic television program or movie is made by shooting various shots and scenes, often out of sequence, and then arranging the shots and scenes according to the script for the program or movie. Depending on the program or movie, each scene may be filmed either indoors or outdoors. In either case, a scene may be filmed either "on location" and/or on a "set". As the name implies, shooting on location involves filming that takes place away from a studio, or similar facility, and often may be carried out without significant modification to the environment, although a significant amount of professional lighting equipment is still required. In contrast, for each scene that is not filmed on location, a physically distinct set must be created from scratch to replicate reality or embody a chosen visual style as faithfully as possible. The lighting of a set contributes significantly to the degree to which reality, or a chosen visual style, can be captured by each set.

On average, a dramatic television series uses between fifteen and twenty sets located in one or two studio buildings. Each set has three walls, the fourth wall being open to accommodate the cameras. The sets are generally built in clusters of two to four sets that share back walls. Because of sound considerations, the cast and crew shoot in only one set at a time. Conventionally, each set is equipped with heavy stationary overhead rods, suspended from the ceiling, that support an assemblage of lights and fixtures that are customized for that particular set. These rods may take the form of a grid of horizontal trusses hanging from a number of vertical trusses that are welded or otherwise fixed to a heavy-load-bearing roof. This grid may extend over a plurality of sets. These lights and fixtures typically remain on the grid, even though only one set is in use at any one time.

It is noted that, in this description, the term "light" is used to refer generally to the light source, i.e., the bulb or lamp, such as tungsten/incandescent bulb, quartz/halogen bulb, carbon arc lamp, and the like. The term "fixture", on the other hand, is used to refer generally to the housing of the light, including lenses and shutters, as well as to some of the backdrops and other items described infra.

Thus, for example, for a dramatic television series, where a single episode may include scenes from a living room, a bedroom, and a kitchen, each of the "living room", "bedroom", and "kitchen" sets is built separately, and each must have its own lights and lighting fixtures attached to overhead rods. The "living room" lights are coordinated for the living room set only. The crew cannot simply move the "living room" lights for use in the "bedroom" or "kitchen" sets, except by painstakingly disconnecting them one by one from the overhead rods. In this way, the prior art creates very high labor and material costs because a fixed lighting assemblage must be custom-built for each set. Because the crew shoots in only one set at a time, vast amounts of lighting and rigging hang dormant most of the time, even during production. Each assemblage must be discarded (or, at the very best, disassembled) once the set is of no more use. In addition, even within the same set, the lights and fixtures cannot be rearranged without the investment of a considerable amount of time and labor.

Moreover, in prior-art stationary rigging systems, such as shown in FIG. 1, the lights and fixtures are fixed to the overhead rods. FIG. 1 shows a depiction of prior-art stationary overhead rigging 101 mounted over (i.e., suspended from the ceiling above) prior-art cluster sets 102, 103 and 104. The crew cannot easily move the lights and fixtures horizontally or vertically to accommodate the requirements of a scene. This is significant because the size of sets for films, television series and other entertainment varies among and within productions. For instance, the size of sets constructed to resemble interiors for a legal drama may be far smaller than the size of sets constructed to resemble exteriors for a science fiction series. Furthermore, within the legal drama, the set for a junior attorney's office may be far smaller than the set for the courtroom.

Thus, the use of prior art rigs, such as that depicted in FIG. 1, is expensive and inefficient because the use of each light and fixture is limited. The present invention, because of its greater versatility, requires fewer lights and fixtures to achieve the same range of effects, even within a single set, than the prior art requires.

It is known in the art to provide compact, folding truss units that may be readily transported and used, for example, with touring stage shows. While such compact units may be readily transported, assembled and disassembled, their use is very limited. Since they are primarily designed for ease of assembly and transportation, they cannot accommodate the range of lighting and other equipment that is necessary for studio production, indoor/outdoor shows or performances, etc.

The features and advantages of the present invention will be explored through the following description and drawings. It should be understood, however, that the detailed description and specific examples, while indicating particular embodiments of the invention, are given by way of illustration only, and various modifications may naturally be performed without deviating from the spirit of the present invention.

SUMMARY OF THE INVENTION

Figure 1:
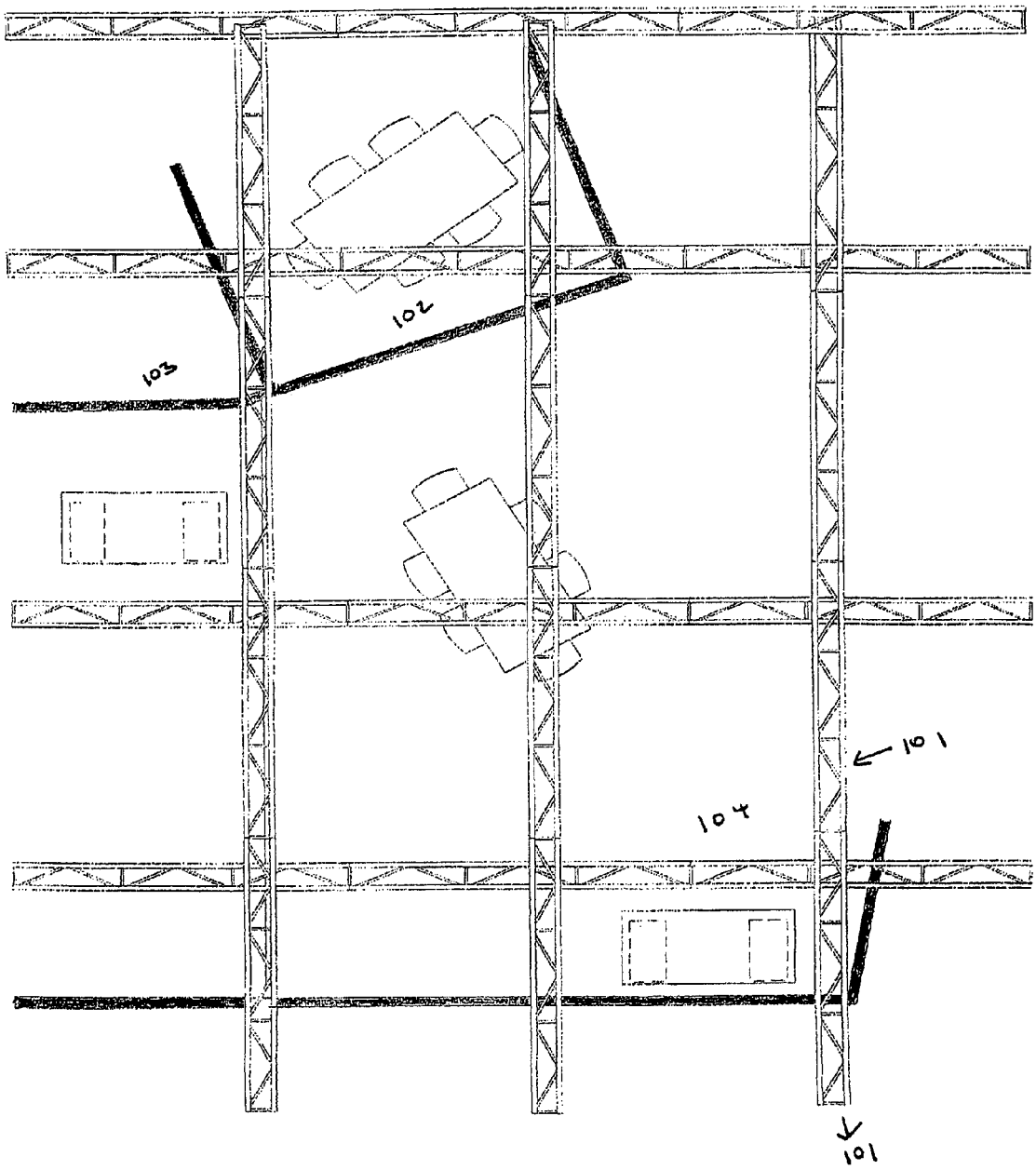
FIG. 1 shows prior-art stationary overhead rigging suspended from the ceiling above prior-art cluster sets.

The present invention overcomes the shortcomings of prior-art systems of the type generally discussed above. First, the present rig is portable, i.e., moveable. As such, the rig can be moved swiftly and easily between and among sets, reset at the touch of a button according to digital presets or re-programmed, and re-used. In an example of the present invention disclosed herein, the rig can be moved from the "living room" set to the "kitchen" or "bedroom" set and be ready for use in minutes. In this way, the present invention eliminates much of the material and labor costs associated with building a cumbersome individually customized rig for each set and with making adjustments and repairs thereto. For example, in a studio containing twenty sets, the number of rigs would be reduced from twenty to one. Similarly, the number of (often very expensive) lights and fixtures would also be reduced to about one-twentieth of that used in connection with a conventional rigging apparatus. Thus, even if it were to cost more to build one rig according to the present invention as opposed to one rig according to the current state of the art, the present invention will still result in significant cost savings for a television or film production since fewer rigs would be needed.

An additional cost-saving feature of the present invention stems from the fact that the present invention may be smaller than the multi-set rigs that are known in the art. Since it does not needlessly duplicate parts that will sit idle over other sets while others are in use, there are fewer parts. For example, fewer lights, and fewer dimmers for those lights, will be required. Less complex systems generally have fewer problems, since there are fewer parts to break. As such, it is anticipated that the cost of maintenance of the present invention will be lower than those systems known in the art.

The present invention also reduces the material and labor cost that is associated with building a building having a roof or similar structure that is capable of supporting the prior-art stationary rigging suspended therefrom. Since the weight of the rigging of the present invention is supported by the floor, the building which houses the rigging of the present invention does not have to be designed to support the weight of a traditional rigging from the ceiling.

Second, in contrast to prior-art stationary rigging, which is immovably suspended above the set, the present rig is on the ground. With prior-art systems, in order to move or replace a light or fixture, a worker must mount a ladder or, very often, use a forklift or other motorized vehicle or device, because of the height of the rigging. This, in turn, generally requires that the worker move furniture and props within a set. In addition, sometimes, the worker must add to, or subtract from, the very structure of overhead rods. Embodiments of the present invention, in contrast, allow changes to be made without the need for any of the foregoing, which translates into savings in time and labor. Moreover, because the rig is movably stationed on the ground during use for filming in one set, the rig can be wheeled to a "home" position outside of any set, and/or to another set, almost immediately after filming is finished in the first set. The crew can make necessary adjustments and repairs while the rig is in any of these locations.

Such repairs may include replacing light bulbs or fixtures. Since the bulbs and fixtures of the present invention are moveable, the bulb or fixture that needs to be repaired may be automatically or manually lowered to a position that is more accessible for repairs. This saves the time and expense of locating a lift and raising a person up to the rigging to perform the necessary repairs.

In addition, in studio facilities housing studios for more than one program—for example, news, talk and game shows—the rig could be moved among studios when necessary or convenient in connection with the taping schedule.

Third, the present invention allows both the size and cost per square foot of studios to be reduced significantly. The present invention eliminates the need for construction of a heavy-load bearing roof that can bear the weight of an elaborate system of heavy suspended trusses from which hundreds of lights and fixtures hang over multiple sets. Thus, the invention reduces the cost of constructing new studios and allows productions to consider shooting in lower-cost spaces not originally designed as studios.

Furthermore, the present invention eliminates the time now required to build the prior-art stationary rigging. For an average dramatic television series, construction of the rigging takes two or more weeks. The costs associated with the construction include massive amounts of trusses, lights, fixtures and construction equipment, rental of studio space (or downtime for owned studio space), and significant labor costs. Moreover, in the event that a "pilot" is not picked up or a series is cancelled, most of the foregoing costs associated with the prior art are sunk costs—in other words, losses. In addition, further costs will be incurred in dismantling the rigging. The present invention, by contrast, may simply be leased, easily modified to the extent necessary and returned to the lessor in the event of the termination of a program. Even in the event that a producer purchases the present rig for use in a program that is later cancelled, the producer may sell the rig intact to another production.

In addition, when the prior art is used, multiple sets must be built regardless of whether one set could be otherwise transformed into another set (e.g., a living room transformed into a dining room) with relative ease. Such transformation would not be practical because the entire lighting rig would also have to be rearranged, and perhaps even rebuilt, depending on which set was being used. The rig of the present invention, on the other hand, can be swiftly and easily adapted to light the same set differently as well as to light different sets simply by changing the settings on a computer console.

Fourth, within any given set, the present invention is far more versatile than prior-art systems. The present invention allows the lights and fixtures, as well as the frameworks, trusses, structural members, etc. to be physically moved horizontally and vertically and otherwise manipulated via remote control. Prior-art rigs only allow the lights to be brightened or dimmed, and in some cases, manually tilted from a stationary position. The ability to move the trusses and frameworks both horizontally and vertically allows a crew to expand and contract the rig to adapt to sets of varying vertical and horizontal dimensions, thus obviating the need for production designers to adapt the size of the set to the rig. Also, the versatility of the present rig allows a much greater variety of lighting effects with the same or fewer lights and fixtures than are required with prior-art rigs.

Fifth, the present rig includes flexible, adaptable backdrops for all of the doors and windows in a set. In television and film production, painted backdrops or screens are used on studio sets to simulate what would be outside a door or window—for instance, a streetscape, a meadow, mountains, etc. Also, blinds, shades and drapes are used to modulate the light and shadows that seem to come from the windows. The present rig includes a system of blinds, lights, painted and photographed backgrounds and screens. All of the foregoing can be adapted for each set and pre-programmed along with corresponding light settings. The present invention represents an advance over the prior art, in connection with which each backdrop and blind must be individually manually installed.

Figure 2:
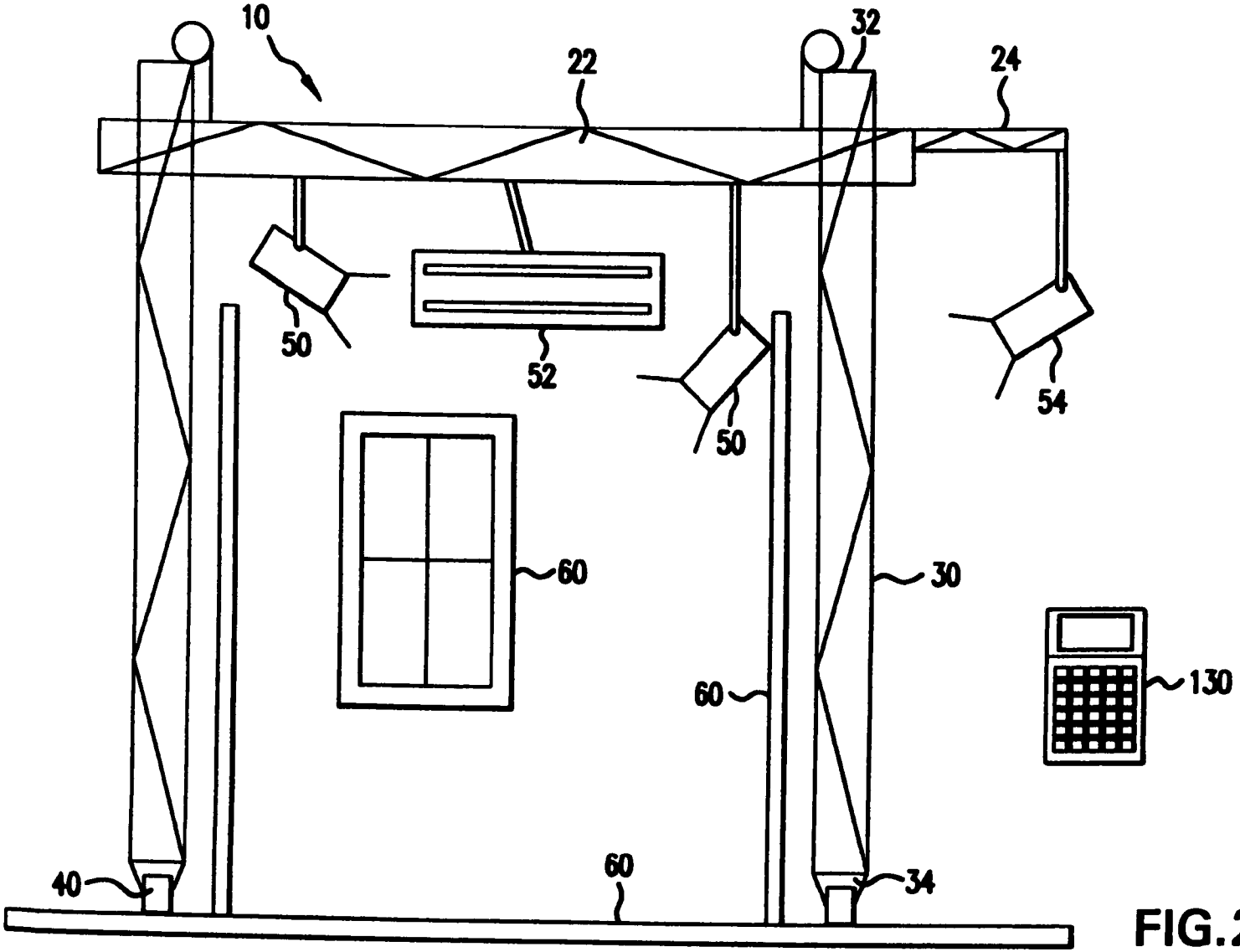
FIG. 2 shows a side view of a rig having fixtures connected thereto.

Such programming of the light and background systems may be controlled by a controller 130, as shown in FIG. 2. This controller may be designed in any form that is known in the art including, but not limited to, the form of a computer station, a hand-held controller device, or a lighting board. The settings of these systems may be pre-programmed or set in the controller's memory. In this manner, when the present invention is used for a second time on the same set, it may provide lighting at the same angle and intensity as the previous time it was used on the set. This feature allows the present invention to provide the features of the systems reliably, and without variations between uses, without requiring time-consuming set-up every time the present invention is used. Of course, it should be understood by one skilled in the art that the lights may be manually adjusted should the user desire.

Sixth, the system of the present invention may include a computer, whereby the rig, as well as the lights, fixtures, and other devices, such as backdrops, can be remotely controlled and even pre-programmed for each set. At present, in television and movie production, computers are generally used only to control the intensity of light, not to move the lights, fixtures, and other devices. Thus, the present invention reduces costs associated with labor and personnel.

Figure 6:
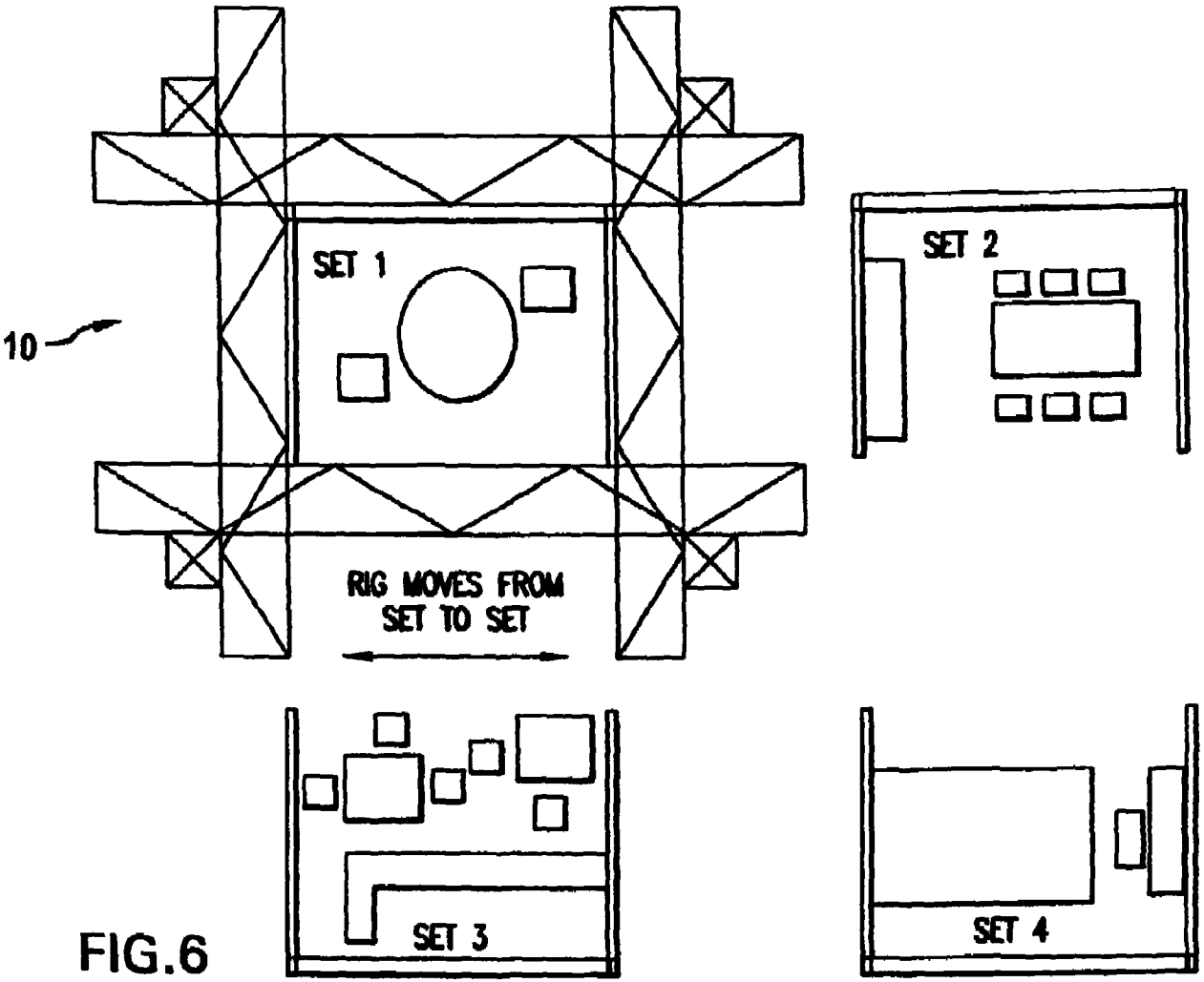
FIG. 6 is an overhead view of how the rig according to an embodiment of the invention may be moved from set to set in an "assembly line" process of production.

Finally, as shown in FIG. 6, the present invention allows for simplification of, and increased efficiency in, the process of set construction and production. More specifically, with the present invention, each set can stand freely; it does not have to be part of a cluster with shared walls. The present rig may be positioned over each set and moved between sets in "assembly line" fashion. The sets may be positioned in straight rows as in the manner of traditional assembly lines, but may also be positioned in circles, squares, or any other configuration that allows the rig to be moved between sets.

In one embodiment of the present invention, two or more of the present rigs may be placed adjacent to each other or physically connected in modular fashion if appropriate for the circumstances. This linking may be linear, or at any other angle. The rigs may be secured together by any means that is known in the art. For example, two rigs may be connected in a linear disposition by placing nuts and bolts through adjacent rig truss members. To join two rigs at an angle, hinge means such as linking brackets can be bolted or otherwise attached to the end members of the rigs. An extendable brace clamped to the linking brackets can create an angle at the vertex of the hinges.

An embodiment of the present invention is related to a set lighting system, also referred to as a "lighting rig" (or, simply, a "rig"), comprising a horizontal framework that is disposed on a plurality of vertical members (e.g., posts) in such a way as to allow the framework to move up and down relative to the vertical members. The latter, in turn, are equipped with rollers, wheels, coasters, slides, or the like so as to allow the entire rig to be moved from one set to another. Lights, lighting fixtures, and other similar fixtures are attached to the framework in such a way as to enable the system to be remotely controlled. Specifically, in an embodiment of the invention, the lights, fixtures, and/or framework are computer controlled. As such, the operation, intensity, angle, height, and other similar specifications of the system can be pre-programmed, and the rig remotely operated, as needed.

DETAILED DESCRIPTION

Figure 3:
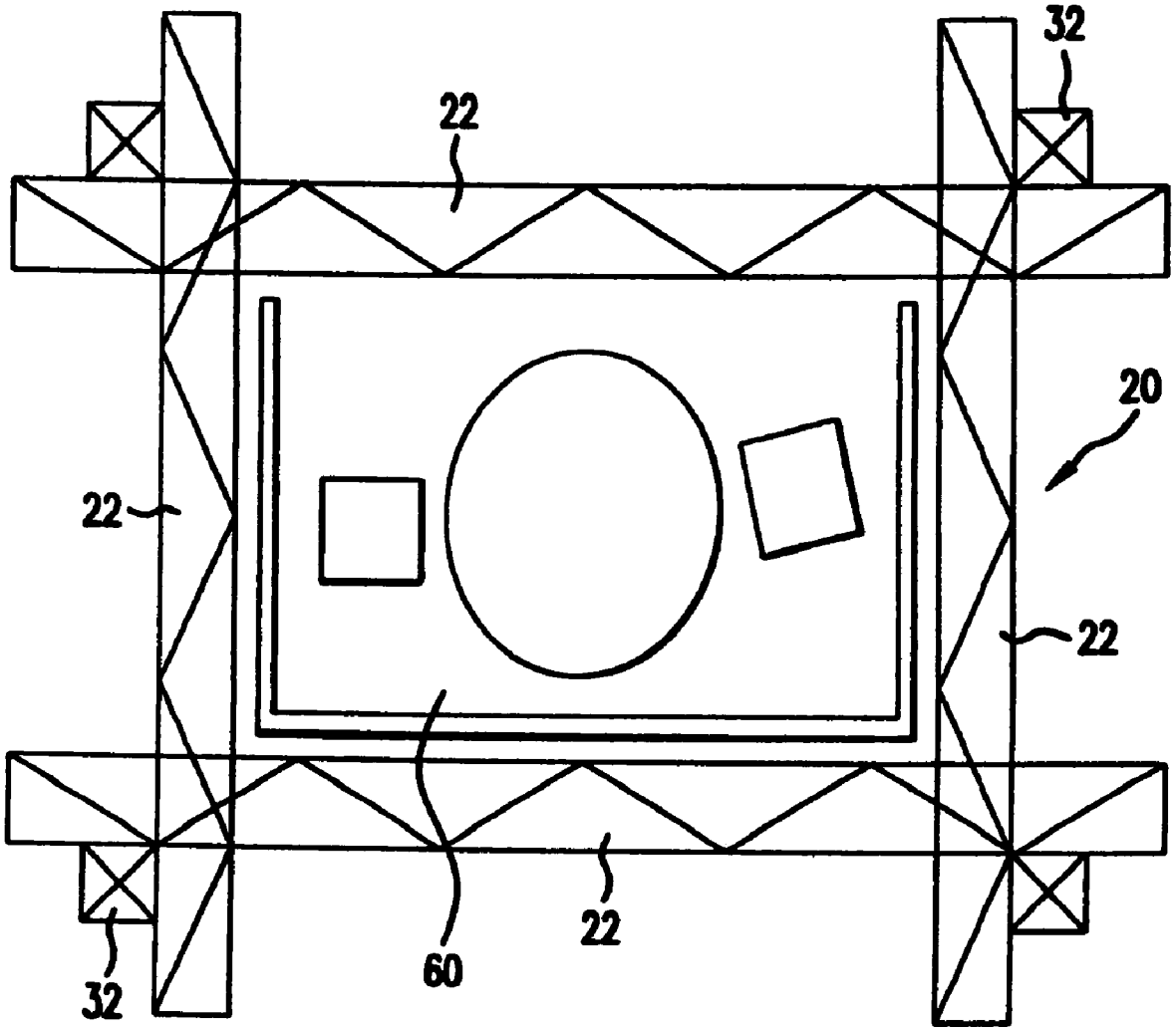
FIG. 3 shows a top view of a rig on a set.

FIGS. 2 and 3 show one embodiment of the system of the present invention. As shown in these figures, a set lighting system 10 is positioned adjacent a set 60 and comprises a horizontal framework 20. The framework 20 is disposed on a plurality of vertical members 30 and includes horizontal members 22 which, in a preferred embodiment, are arranged in the shape of a rectangle. However, it will be apparent to the person of ordinary skill in the art that other arrangements (e.g., elliptical, circular, etc.) may also be adopted in accordance with the geometric and lighting requirements of a particular set.

Vertical members 30 have free upper ends 32 and lower ends 34. The lower ends 34 of the vertical members 30 are equipped with rollers, or other similar means, such as wheels, coasters, slides, or the like, so as to allow the entire system 10 to be moved from one set to another. At locations toward the upper ends 32, the vertical members 30 are connected to the framework 20.

As shown in FIG. 2, the framework 20 has attached to it a multiplicity of lights 50 and lighting fixtures 52. In addition, the framework 20 may be equipped with one or more extension arms 24. In practice, the extension arms 24 provide rigging space for one or more fixtures and/or backdrop lights 54.

The lighting system of the present invention is adapted to be used in conjunction with a digital processor (not shown). The digital processor (e.g., a computer) may be pre-programmed to electronically, and remotely, operate the lighting system of the present invention by means, and in a manner, that are known in the art. For example, the digital processor may, through electronic communication with a controlling means (e.g., digital control panel, DMX system) control the height of the framework 20, as well as the characteristics (e.g., the intensity, angle, etc.) of the lights 50, light fixtures 52, and back drop lights 54.

In a preferred embodiment, the framework 20 is supported only by the vertical members 30. As such, there is no requirement that the framework, or the system, be suspended, or otherwise fixed, above the set. On the contrary, the system 10 remains in contact with the ground for the duration of its use in, e.g., filming a set. The actual structure that provides for connection of the horizontal framework 20 and the vertical members 30 to each other may be of a configuration known in the art.

In addition, in embodiments of the invention, the rig may have greater than four vertical members and/or greater than four horizontal members associated with a conventional framework. The additional members allow a crew to affix more lights, fixtures, extension arms and the like to the rig to increase the number and variety of lighting effects that may be achieved.

In practice, the lighting system 10 is rolled onto a set 60 using the moving means 40, with lights 50, light fixtures 52, and backdrop lights 54 attached to the framework 20. The position of the rig can be preprogrammed by computer. The height of the framework is adjusted in accordance with the height of the walls in the set, as well as the lighting requirements of the set. Once in position, a controller is used to adjust and operate the lights and other fixtures either in real time, or according to a pre-programmed scheme using a digital processor. When filming on the set is finished, the lighting system 10 can be moved to another set for use therewith, or it can remain stationary, and the set can be changed to depict a different scene, with the framework, the lights, and light fixtures adjusted to meet the lighting requirements of the second set.

In one embodiment of the present invention, the system is configured so that the framework 20 can move vertically with respect to the vertical members 30, so as to allow flexibility and versatility in lighting with respect to a specific set. The actual structure that connects the framework 20 to the vertical members 30 may be of a configuration that is known in the art.

Figure 7B:
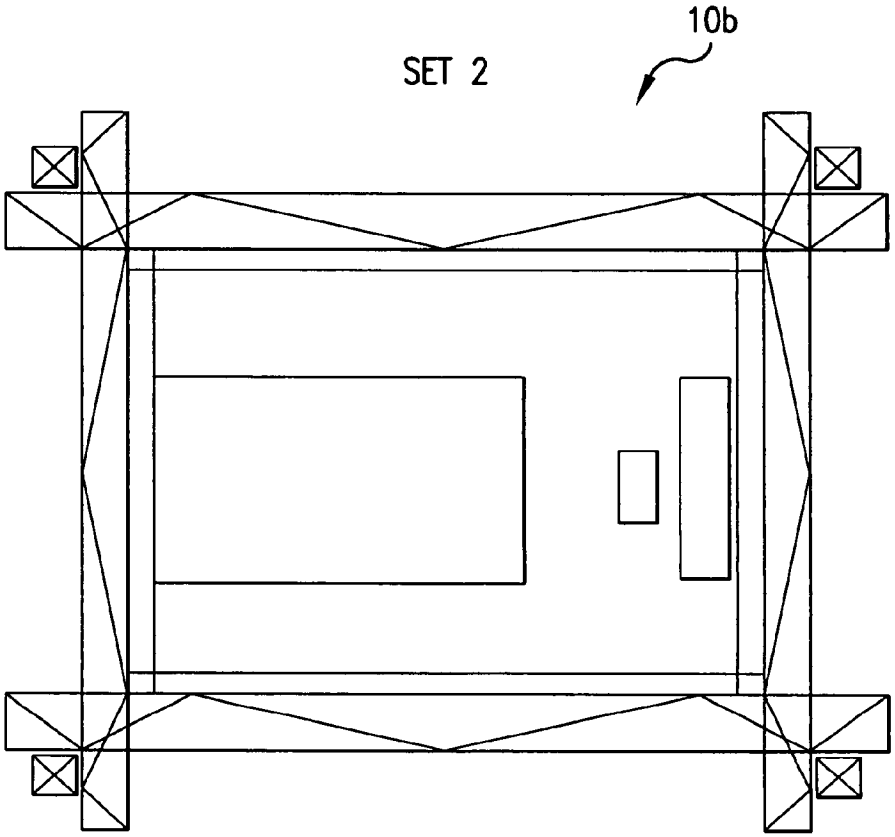
FIGS. 7*a* and 7*b* show an overhead view of a lighting system according to an embodiment of the invention, wherein, after use in a first set, the horizontal dimensions of the system have been expanded to accommodate the larger size of a second set.
Figure 7A:
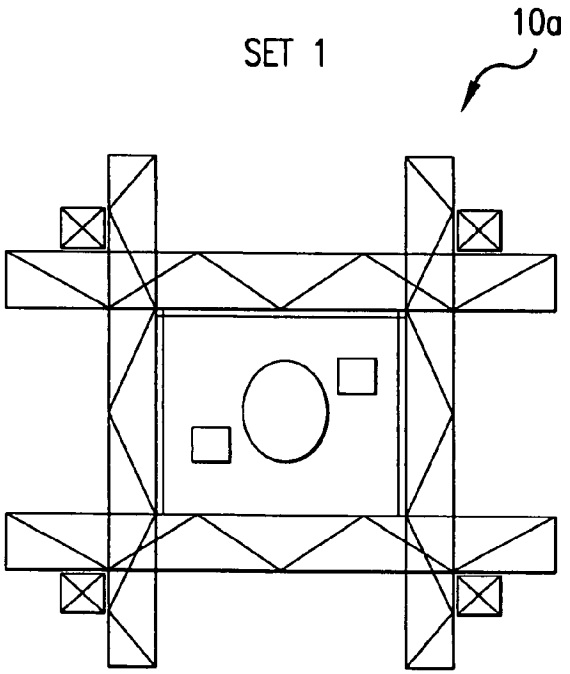

In a preferred embodiment, the vertical members 30, in turn, are disposed in such a way as to allow them to move left and right, as well as forwards and backwards, with respect to the horizontal members 22, thereby adjusting the horizontal dimensions of the system 10. Thus, in the illustrated example, where the horizontal framework 20 is in the shape of a rectangle, either the "width" and/or the "length" of the rectangle may be adjusted. In this way, a crew may expand and contract both the horizontal and vertical dimensions of the rig so as to adapt it to the dimensions of a particular set. Thus, as shown for illustrative purposes in FIGS. 7*a* and 7*b*, the system 10 may be adjusted to a first horizontal (and vertical) configuration 10*a* for use in a first set (see FIG. 7*a*), and then re-adjusted to a second horizontal (and, if need be, vertical) configuration 10*b* for use in a second set (see FIG. 7*b*). As mentioned, the horizontal and/or vertical adjustments may be made by using a controller in real time, or according to a pre-programmed scheme using a digital processor.

In one embodiment of the invention, the vertical and horizontal members of the rig are of a fixed length long enough to accommodate the largest set in connection with which use of the system is anticipated. In this case, the crew moves the vertical and/or horizontal members along their counterparts to accommodate smaller sets of varying sizes.

Figure 4:
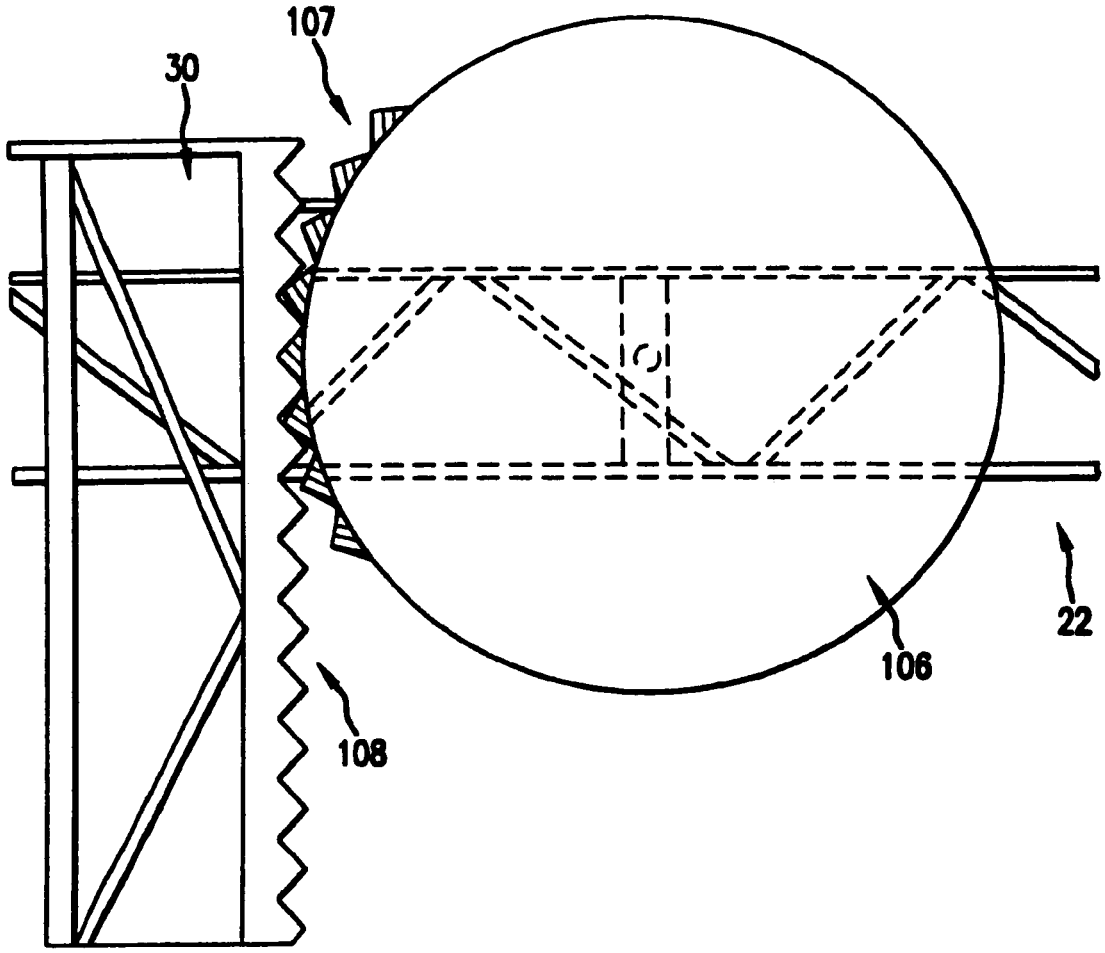
FIG. 4 is an enlarged view of one mechanism for vertically adjusting horizontal frameworks, members, and/or trusses, and for horizontally adjusting vertical frameworks, members, and/or trusses according to an embodiment of the invention.

FIG. 4 is an enlarged view of one mechanism for vertically adjusting horizontal frameworks, members, and/or trusses, and for horizontally adjusting vertical frameworks, members, and/or trusses according to an embodiment of the invention. The mechanism shown in FIG. 4 takes the form of a cogwheel. The teeth 107 of the cogwheel 106 mesh with corresponding teeth 108 on the apparatus. Thus, in FIG. 4, turning of the cogwheel in one direction will serve to raise the horizontal members 22, while turning the cogwheel in the opposite direction will lower the horizontal members 22. A similar structure may also serve to effect horizontal movement of the vertical members 30 relative to the horizontal framework 20. The turning of the cogwheel may be powered manually, electrically, hydraulically, electro-hydraulically, or by any other means as is known in the art.

Figure 5:
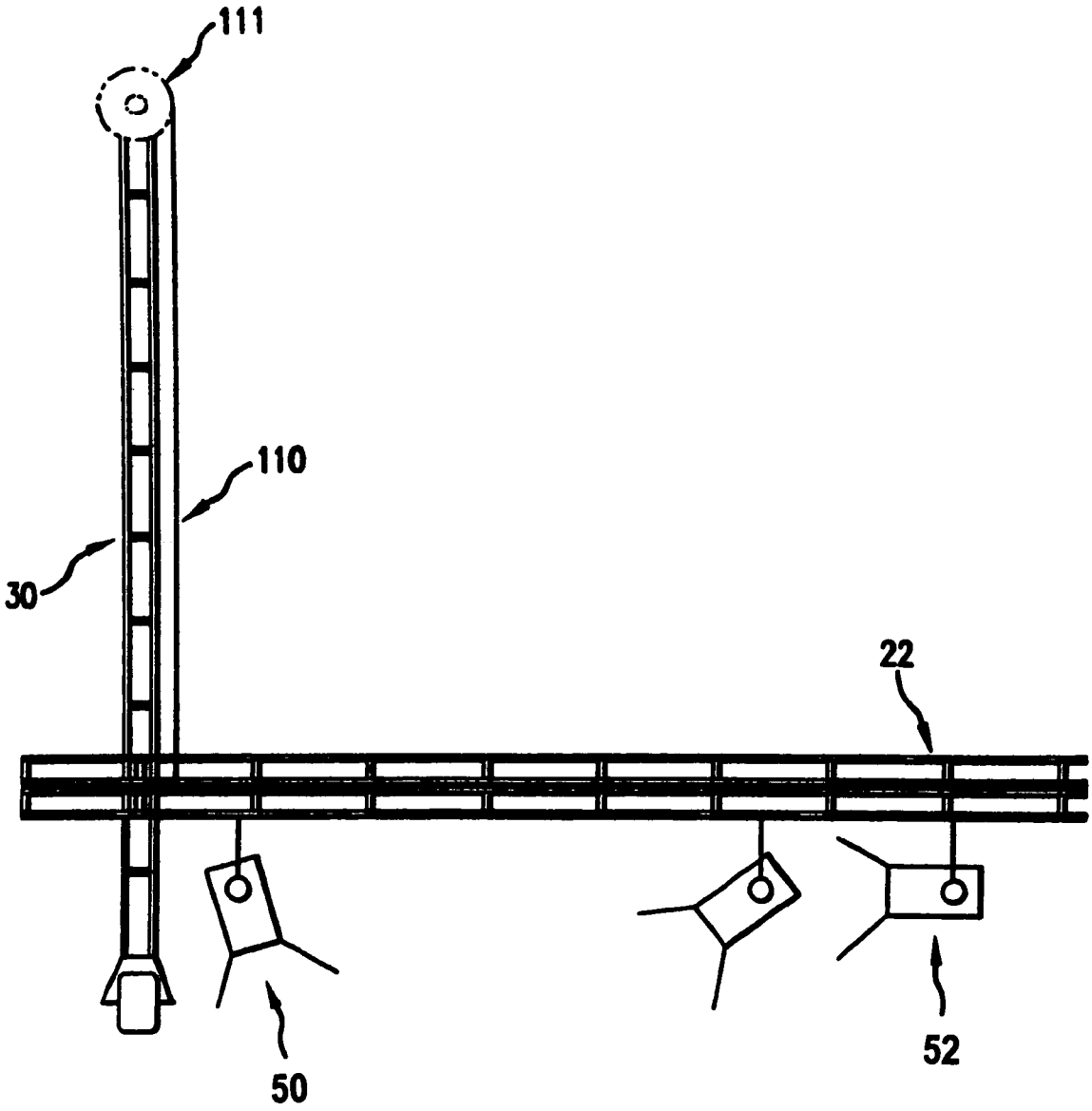
FIG. 5 shows another mechanism for vertically adjusting horizontal frameworks, members, and/or trusses, and for horizontally adjusting vertical frameworks, members, and/or trusses, with the rig in "low" mode for maintenance of lights, fixtures, etc., all according to an embodiment of the invention.

FIG. 5 shows an alternative mechanism for vertically adjusting the horizontal framework/trusses 20 according to an embodiment of the invention. The mechanism shown in FIG. 5 takes the form of a cable 110 and pulley 111 mechanism. This mechanism may be powered manually, electrically, hydraulically, electro-hydraulically, or by any other means as is known in the art. In FIG. 5, the horizontal framework 20 is depicted in "low" mode for maintenance of lights 50 and fixtures 52. Again, the same mechanism may also be employed to horizontally move the vertical members 30 relative to the horizontal framework 20.

In an alternate embodiment of the invention, the length of the vertical and horizontal members themselves may be adjusted, e.g., via the use of telescoping material, wherein a member is composed of multiple parts that slide into and out of each other to effect contraction and expansion, respectively, and then fixed by any means known in the art, such as nuts and bolts, brackets, braces, button-hole combinations, and the like. In another alternate embodiment of the invention, any or all of the vertical and horizontal members may be extended by attaching additional lengths of trussing material by any means known in the art, including nuts and bolts, brackets, braces and the like.

Once the horizontal trusses have been raised to the desired height, and the vertical members/trusses have been adjusted to the desired horizontal dimensions, the former should be fixed at that height, and the latter, with that specific horizontal configuration, so that they do not change position and the lighting provided remains constant. Such fixation may be effectuated by a spring-loaded pin or similar mechanism that will lock the various structural members/trusses in place. In a preferred embodiment, locking mechanisms are located at the corners of the rig. However, the type, number, and placement of locking mechanisms may vary.

FIG. 6 is an illustration of an embodiment of the present invention, depicting an overhead view of how the rig according to an embodiment of the invention moves from set to set in an "assembly line" process of production. As shown in FIG. 6 the rig 10 may be moved, e.g., manually or by remote control, to a position over an individual set when the set is in use. As shown in FIG. 6, the rig 10 is over set 1. The sets in the "assembly line" should be designed so as to allow room for the rig 10 to move between and among sets. The sets may be positioned in straight rows as in the manner of traditional assembly lines, but may also be positioned in circles, squares, or any other configuration that allows the rig 10 to be moved between sets. In addition, two or more of the present rigs 10 may be placed adjacent to each other or physically connected in modular fashion if appropriate for the circumstances.

In embodiments of the invention, the rigidity of the rig 10 may be maintained by constructing the various (structural) members from material known in the art to be sufficiently strong to meet the anticipated requirements of the system. In addition, horizontal diagonal stabilizing members, and/or an adjustable horizontal planar deck, e.g., two sliding planes that can be locked into place by any means known in the art, may be used.

Figure 8A:
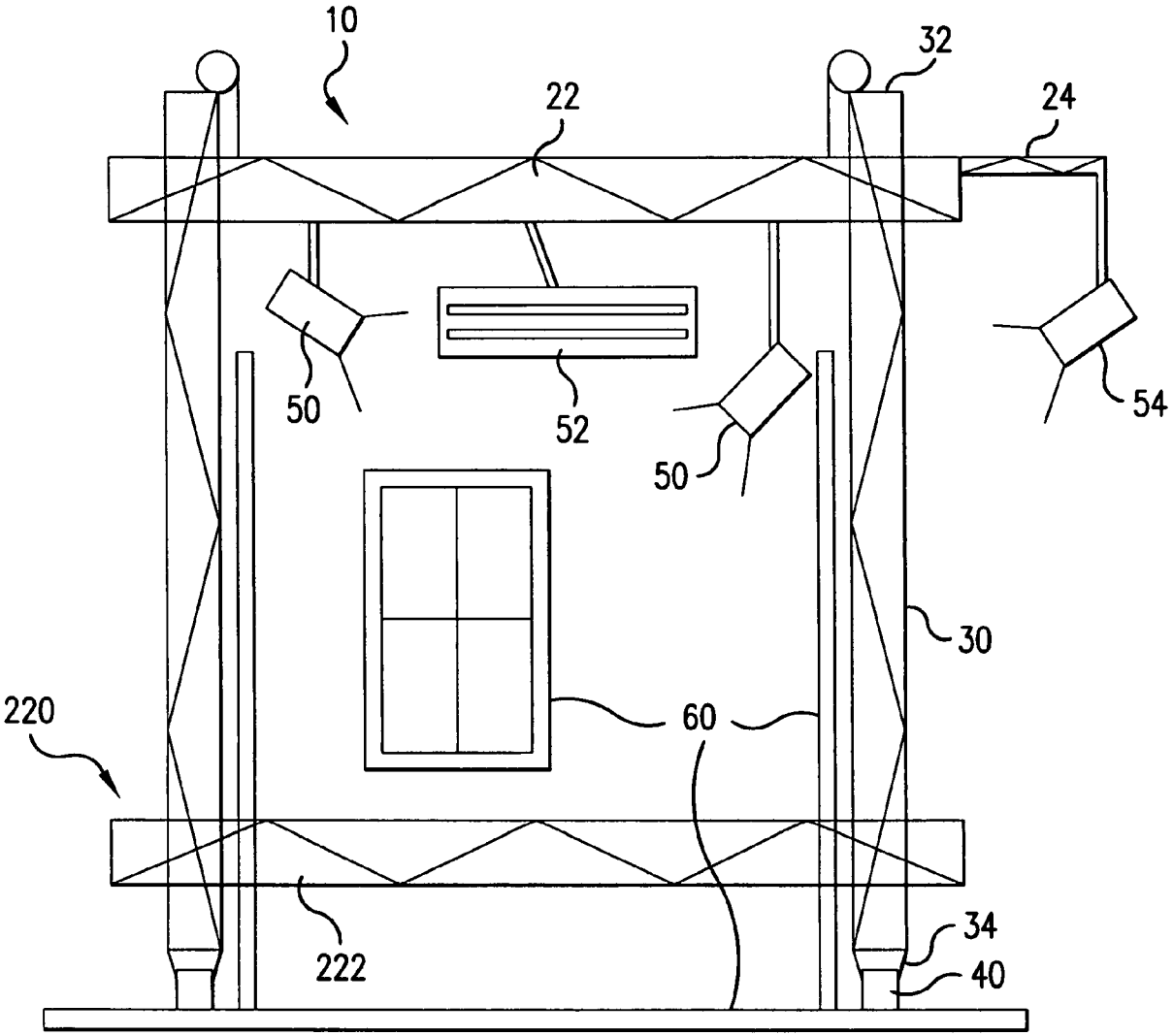
FIGS. 8*a* and 8*b* show an alternative embodiment of the invention.
Figure 8B:
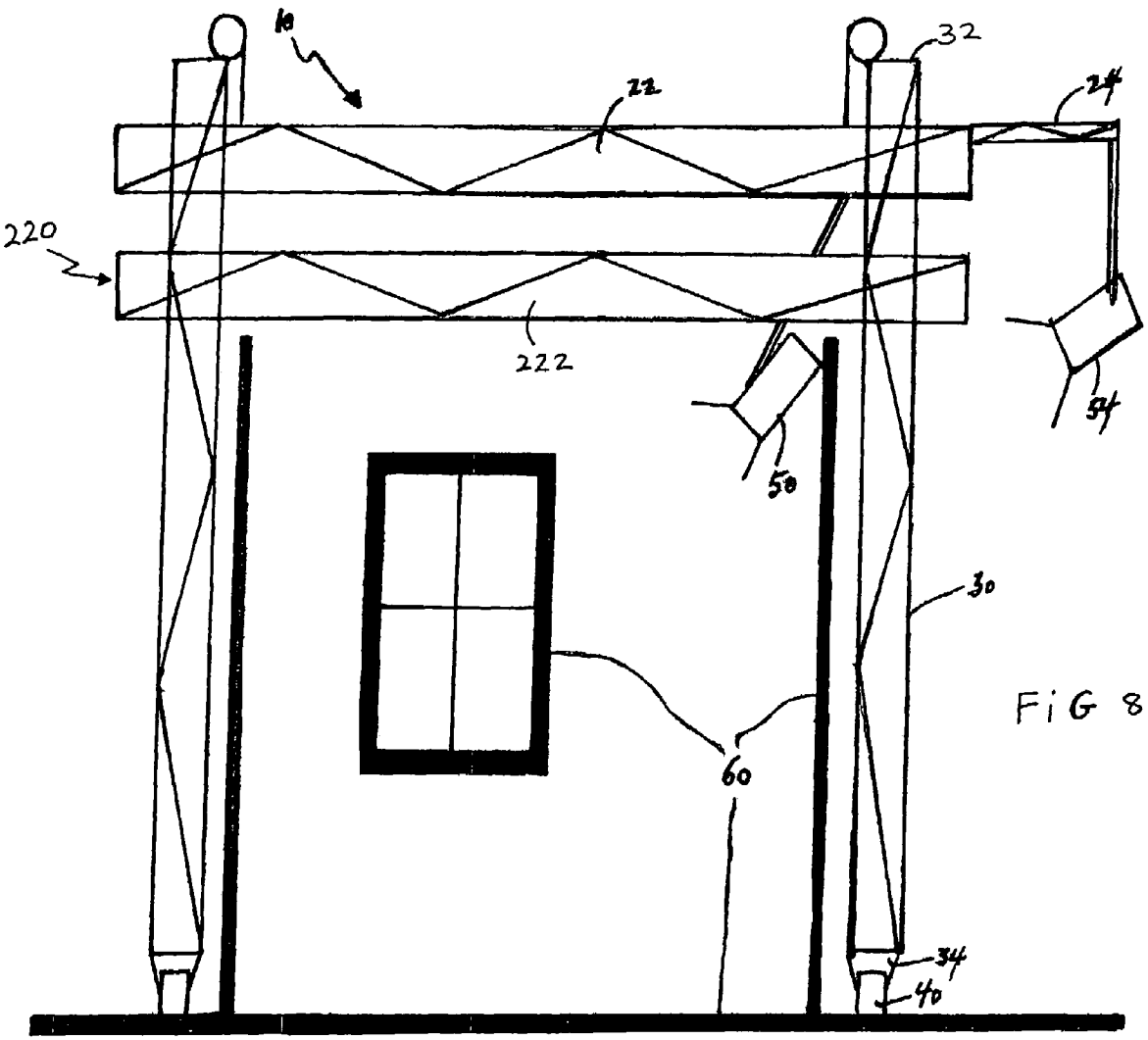

In embodiments of the present invention, the rig 10 may include more than one horizontal framework 20. In these embodiments, the additional framework(s) provide not only additional stability to the overall system, but also additional set(s) of horizontal members to which more fixtures, backdrops, extension arms, etc. may be connected for use with various sets. Thus, FIGS. 8*a* and 8*b* show a rig in which two adjustable horizontal frameworks 20,220 have been employed. As depicted in these figures, the height of the additional framework 220, having horizontal members 222, may be adjusted (e.g., shown lowered in FIG. 8*a* and raised in FIG. 8*b*) as needed.

In addition, the vertical members 30 may be adjusted horizontally with respect to both frameworks 20,220 in the manner discussed previously in connection with a rig having a single horizontal framework. Also, as discussed previously, lights, lighting fixtures, backdrops, screens, blinds, shades, drapes, etc. may be connected to one or more of the horizontal frameworks for use in various sets.

It will be apparent to a person of ordinary skill in the art that embodiments of the present invention are not limited in their design or application to specific embodiments disclosed herein. Thus, the present invention is intended to encompass all of the embodiments disclosed and suggested herein as defined by the claims appended hereto and any equivalents thereof.

What is claimed is:

1. An adjustable lighting system, comprising:

a first horizontal framework connected to a plurality of vertical members having upper and lower ends;

a moving member coupled to each of said lower ends to move the system;

a plurality of fixtures connected to the framework;

means for controlling the operation of said fixtures; and a digital processor in electronic communication with the controlling means, wherein the digital processor has programmable means so as to allow pre-programming of an operation of said fixtures;

the digital processor is adapted to remotely control the operation of said fixtures;

the vertical members are horizontally moveable with respect to the framework so as to allow adjustment of the horizontal dimensions of the framework;

the moving members are in contact with a horizontal surface during use of the system; and the framework is supported solely by said plurality of vertical members during use of the system.

2. The lighting system of claim 1, wherein the framework is configured to be vertically moveable with respect to the vertical members.

3. The lighting system of claim 2, further including means for adjusting the height of said framework.

4. The lighting system of claim 1, further including means for adjusting the horizontal dimensions of said framework.

5. The lighting system of claim 1, wherein the fixtures are selected from the group consisting of lights, lighting fixtures, backdrops, screens, blinds, shades, drapes, and combinations thereof.

6. The lighting system of claim 1, wherein said lighting system is configured to be used with a plurality of sets that is constructed to allow movement of the lighting system between and among the sets with said moving members.

7. The lighting system of claim 6, wherein said plurality of sets is constructed so as to have no shared walls.

8. The lighting system of claim 1, further including a second horizontal framework connected to said plurality of vertical members and disposed at a vertical distance from the first horizontal framework.

9. The lighting system of claim 8, wherein the second framework is horizontally adjustable, a plurality of controllable fixtures are connected to the second horizontal framework, the lighting system further includes a digital processor adapted to remotely control the operation of said fixtures, and the fixtures are selected from the group consisting of lights, lighting fixtures, backdrops, screens, blinds, shades, drapes, and combinations thereof.

10. The lighting system of claim 9, wherein said first and second frameworks are configured to be vertically moveable with respect to the vertical members and the lighting system includes means for adjusting the height of each of said frameworks.

11. The set lighting system of claim 8, wherein said lighting system is configured to be used with a plurality of sets that is constructed to allow movement of the lighting system between and among the sets with said moving members.

12. The lighting system of claim 11, wherein said plurality of sets is constructed so as to have no shared walls.

13. The lighting system of claim 1, wherein the horizontal surface is the ground.

14. An adjustable lighting system, comprising:

at least two horizontal frameworks connected to a plurality of vertical members having upper and lower ends;

a moving member coupled to each of said lower ends to move the system;

a plurality of fixtures connected to at least one of the frameworks;

means for controlling the operation of said fixtures; and a digital processor in electronic communication with the controlling means, wherein the digital processor has programmable means so as to allow pre-programming of an operation of said fixtures;

the digital processor is adapted to remotely control the operation of said fixtures;

the moving members are in contact with a horizontal surface during use of the system; and the frameworks are supported solely by said plurality of vertical members during use of the system.

15. The lighting system of claim 14, wherein the horizontal frameworks are configured to be vertically moveable with respect to the vertical members.

16. The lighting system of claim 15, further including means for adjusting the height of each of the frameworks.

17. The lighting system of claim 14, wherein said vertical members are horizontally moveable with respect to the frameworks so as to allow adjustment of the horizontal dimensions of the frameworks.

18. The lighting system of claim 17, further including means for adjusting the horizontal dimensions of each of the frameworks.

19. The lighting system of claim 14, wherein the fixtures are selected from the group consisting of lights, lighting fixtures, backdrops, screens, blinds, shades, drapes, and combinations thereof.

20. The lighting system of claim 14, wherein said lighting system is configured to be used with a plurality of sets that is constructed to allow movement of the lighting system between and among the sets with said moving members.

21. The lighting system of claim 20, wherein said plurality of sets is constructed so as to have no shared walls.

22. The lighting system of claim 14, wherein the horizontal surface is the ground.

23. A set lighting and production process comprising:

(a) providing a lighting system having:

(1) a first horizontal framework connected to a plurality of vertical members having upper and lower ends, said vertical members being horizontally moveable with respect to the framework so as to allow adjustment of the horizontal dimensions of the framework;

(2) moving means coupled to said lower ends for moving the system;

(3) a plurality of controllable fixtures connected to the framework; and (4) a digital processor in electronic communication with the fixtures and adapted to remotely control the operation of said fixtures;.

(b) providing a plurality of sets in a single location, said sets being arranged so as to allow movement of the lighting system between and among the sets;

(c) operating the moving means to move the lighting system to a first one of said plurality of sets for a first use therein, wherein, during said first use, the lighting system is movably stationed on the ground, the moving means is in contact with the ground, and the horizontal framework is supported solely by said plurality of vertical members; and (d) upon completion of said first use, operating the moving means to move the lighting system to a second one of said plurality of sets for a second use therein, wherein, during said second use, the lighting system is movably stationed on the ground, the moving means is in contact with the ground, and the horizontal framework is supported solely by said plurality of vertical members.

24. The process of claim 23, further including horizontally moving the vertical members with respect to the framework so as to adjust the horizontal dimensions of the framework before at least one of said first use and said second use.

25. The process of claim 23, further including vertically adjusting the framework with respect to the vertical members before at least one of said first use and said second use.

26. The process of claim 23, wherein the plurality of sets is arranged in a configuration selected from the group consisting of a circle, a square, and straight rows.

27. The process of claim 26, wherein said plurality of sets is constructed so as to have no shared walls.

28. The process of claim 23, wherein said fixtures are selected from the group consisting of lights, lighting fixtures, backdrops, screens, blinds, shades, drapes, and combinations thereof.

29. The process of claim 23, further including adjusting the fixtures so as to achieve a first desired lighting effect for said first use, and adjusting the fixtures so as to achieve a second desired lighting effect for said second use.

30. The process of claim 23, wherein a plurality of lighting systems are placed adjacent to one another for at least one of said first use and said second use.

31. The process of claim 23, wherein said lighting system includes a second horizontal framework connected to said plurality of vertical members and disposed at a vertical distance from the first horizontal framework.

32. The process of claim 31, further including vertically adjusting at least one of said first and second frameworks with respect to the vertical members before at least one of said first use and said second use.

33. The process of claim 31, further including horizontally moving the vertical members with respect to the frameworks so as to adjust the horizontal dimensions of the frameworks before at least one of said first use and said second use.

34. A process for lighting multiple sets, the process comprising:

providing a lighting system having:

a first horizontal framework connected to a plurality of vertical members having upper and lower ends;

a moving member coupled to each of said lower ends to move the system;

a plurality of controllable fixtures connected to the framework; and a digital processor in electronic communication with the fixtures, wherein the digital processor has programmable means so as to allow pre-programming of an operation of said fixtures;

the digital processor is adapted to remotely control the operation of said fixtures;

the vertical members are horizontally moveable with respect to the framework so as to allow adjustment of the horizontal dimensions of the framework;

the moving members are supported by a horizontal surface during use of the system; and the framework is supported solely by said plurality of vertical members during use of the system;

moving the rig to a first location;

adjusting the fixtures so as to achieve a first desired lighting effect;

moving the rig to at least a second location; and adjusting the fixtures so as to achieve a second desired lighting effect.

35. The process of claim 34, further including horizontally moving the vertical members with respect to the framework so as to adjust the horizontal dimensions of the framework.

36. The process of claim 34, further including vertically adjusting the framework with respect to the vertical members so as to achieve said first desired lighting effect.

37. The process of claim 34, further including vertically adjusting the framework with respect to the vertical members so as to achieve said second desired lighting effect.

38. The process of claim 34, wherein the framework includes at least one extension arm configured to support at least one backdrop light.

39. The process of claim 34, wherein the first location is a first set.

40. The process of claim 34, wherein the second location is a second set.

41. The process of claim 34, wherein said fixtures are selected from the group consisting of lights, lighting fixtures, backdrops, screens, blinds, shades, drapes, and combinations thereof.

42. The process of claim 34, wherein said multiple sets are constructed to allow movement of the lighting system between and among the sets with said moving members.

43. The process of claim 42, wherein said multiple sets have no shared walls.

44. The process of claim 43, wherein said multiple sets are arranged in a configuration selected from the group consisting of a circle, a square, and straight rows.

45. The process of claim 34, wherein the horizontal surface is the ground.

46. The process of claim 34, wherein said lighting system includes a second horizontal framework connected to said plurality of vertical members and disposed at a vertical distance from the first horizontal framework.

47. The process of claim 46, further including vertically adjusting at least one of said first and second frameworks with respect to the vertical members to achieve at least one of said first and second desired lighting effects.

48. The process of claim 46, further including horizontally moving the vertical members with respect to the frameworks so as to adjust the horizontal dimensions of the frameworks.

* * * * *